US010196857B2

(12) United States Patent
Enloe

(10) Patent No.: US 10,196,857 B2
(45) Date of Patent: Feb. 5, 2019

(54) LADDER KNEE REST

(71) Applicant: J. David Enloe, Oroville, CA (US)

(72) Inventor: J. David Enloe, Oroville, CA (US)

(73) Assignee: ENLOE INDUSTRIES, Roseville, CA (US)

( * ) Notice: Subject to any disclaimer, the term of this patent is extended or adjusted under 35 U.S.C. 154(b) by 33 days.

(21) Appl. No.: 15/414,416

(22) Filed: Jan. 24, 2017

(65) Prior Publication Data

US 2018/0209215 A1 Jul. 26, 2018

(51) Int. Cl.
*E06C 7/00* (2006.01)
*E06C 7/16* (2006.01)

(52) U.S. Cl.
CPC . *E06C 7/00* (2013.01); *E06C 7/16* (2013.01)

(58) Field of Classification Search
CPC .... A41D 13/065; A41D 13/0568; E06C 7/14; E06C 7/16; E06C 7/165; E06C 7/183
See application file for complete search history.

(56) References Cited

U.S. PATENT DOCUMENTS 2,518,107 A * 8/1950 Wilson ..... E06C 7/08 182/106
2,709,626 A * 5/1955 Woodburn ..... E06C 7/16 182/121
3,382,503 A * 5/1968 Ramon ..... A41D 13/0568 182/230
4,211,307 A * 7/1980 Ethridge ..... E06C 7/16 182/121
4,306,700 A * 12/1981 Bell ..... E06C 7/16 182/117
4,928,789 A * 5/1990 Claeys ..... A62B 35/0012 182/230
5,094,319 A * 3/1992 Kobasic ..... E06C 7/16 182/121
5,380,021 A * 1/1995 Doherty ..... A01B 75/00 280/32.5
5,421,428 A * 6/1995 Ingles ..... E06C 7/006 182/106
D372,989 S 8/1996 Gile
6,415,890 B1 7/2002 Tucker
6,637,548 B2 * 10/2003 Pass ..... E04G 1/30 182/120
6,729,438 B1 5/2004 Perrett
7,409,725 B1 * 8/2008 Horstman ..... A41D 13/065 2/22
7,896,131 B2 * 3/2011 Bronkhorst ..... E04G 3/26 182/45
8,225,904 B2 * 7/2012 Davis ..... E04G 3/265 182/45

(Continued)

*Primary Examiner* — Colleen M Chavchavadze
(74) *Attorney, Agent, or Firm* — West & Associates, A PC; Stuart J. West

(57) ABSTRACT

A ladder knee rest comprising a padded frame with top and bottom lateral arms separated by a central support column. The frame can be hung in front of a ladder with a positioning strap, and the length of the positioning strap can be adjusted to move the frame vertically up or down the ladder. Securing straps extending from the lateral arms can be connected behind the ladder and tightened to prevent side-to-side movement. A user's knees can be placed between the padded top and bottom lateral arms to reduce pain and/or discomfort in the user's legs while the user works on the ladder.

16 Claims, 8 Drawing Sheets

(56) References Cited

U.S. PATENT DOCUMENTS

| | | | | |
|---|---|---|---|---|
| 8,251,181 | B2 | 8/2012 | Schapiro | |
| 8,727,074 | B1 * | 5/2014 | Bhajan | E06C 7/165 182/119 |
| 8,752,214 | B1 * | 6/2014 | Maldonado | A41D 13/065 2/22 |
| D728,128 | S | 4/2015 | Haney | |
| 9,890,589 | B2 * | 2/2018 | Goodnow | E06C 7/165 |
| 2004/0069569 | A1 * | 4/2004 | Fraser | E06C 7/16 182/129 |
| 2011/0005863 | A1 * | 1/2011 | Thurner | E06C 5/44 182/129 |

* cited by examiner

LADDER KNEE REST

BACKGROUND

Field of the Invention

The present disclosure relates to the field of ladders, particularly a knee rest attachment for a ladder.

Background

Ladders are commonly used to reach high places. In many cases users stand on ladders for relatively long periods of time, such as while painting high up on a ceiling or wall, picking fruit from trees, or performing construction or maintenance activities. During such extended sessions on a ladder users may want to ease pressure on their legs by resting them against the ladder. However, ladders are generally made of hard materials and often have sharp edges. As such, it can be uncomfortable or even painful for users to rest their knees or other portions of their legs against a ladder for a long period of time.

Some pads for ladders have been developed that provide cushioning to a user's legs or knees. However, these pads generally attach directly to a ladder rung in a manner that is not easily adjustable, such that they cannot be easily moved up and down the ladder when the user changes positions. Most existing ladder pads also only provide a single point of contact for a user's leg. Although the point of contact may be padded, users can experience discomfort when they repeatedly press their legs against a single point of contact.

What is needed is a ladder knee rest that can provide padded contact points both above and below a user's knee. The ladder knee rest should be readily moveable up and down the ladder so that its position can be adjusted as a user changes his or her position on the ladder.

DETAILED DESCRIPTION

Figure 1:
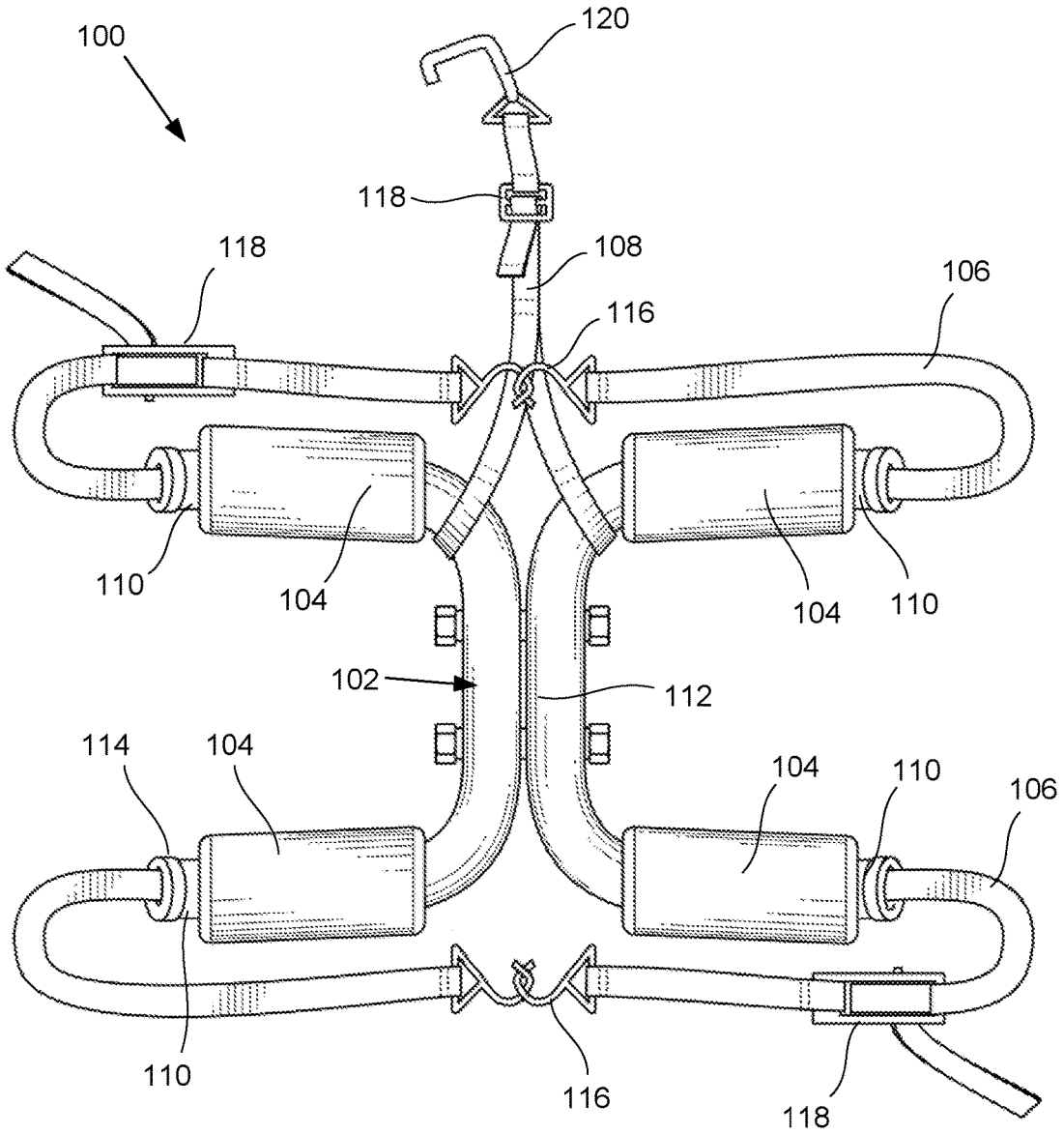
FIG. 1 depicts an exemplary embodiment of a ladder knee rest.

FIG. 1 depicts an exemplary embodiment of a ladder knee rest 100. A ladder knee rest 100 can comprise a frame 102, pads 104, securing straps 106, and a positioning strap 108. The frame 102 can be substantially I-shaped, with lateral arms 110 extending substantially orthogonally in opposing directions from both ends of a central support column 112. The pads 104 can surround and/or cover portions of the lateral arms 110. The top and bottom lateral arms 110 can be substantially parallel, and can be spaced apart at a distance such that a user's knee can be positioned between the top and bottom lateral arms 110 while the user's lower thigh and upper shin can be placed against the pads 104 on the lateral arms 110. The securing straps 106 can extend from the ends of each lateral arm 110. The positioning strap 108 can be coupled with the frame 102 such that the frame 102 can hang on a ladder and be suspended by the positioning strap 108 as will be discussed below.

Figure 2A:
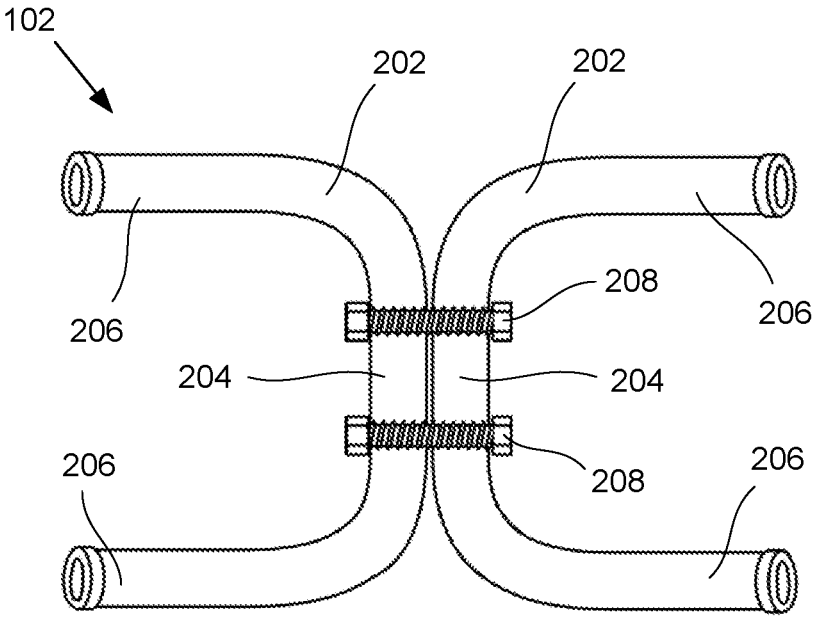
FIG. 2A depicts a first exemplary embodiment of a frame comprising two U-shaped members.

FIG. 2A depicts a first exemplary embodiment of a frame 102. In some embodiments the frame 102 can comprise two U-shaped members 202 coupled together. Each U-shaped member 202 can have a middle section 204 and two end sections 206, with the end sections 206 extending substantially orthogonally away from ends of the middle section 204. The middle sections 204 of the two U-shaped members 202 can be coupled side by side, such that the adjacent middle sections 204 form the frame's central support column 112 and their end sections 206 extend in opposite directions to form the frame's top and bottom lateral arms 110.

In some embodiments the middle sections 204 of the two U-shaped members 202 can be coupled to each other using bolts 208 that extend through the middle sections 204 from one side and are secured with nuts or cap nuts on the other side. In other embodiments the middle sections 204 of the two U-shaped members 202 can be coupled to each other using screws, welding, fusing, adhesives, straps, brackets, or any other connection mechanism.

In some embodiments the joints between the middle section 204 and end sections 206 of a U-shaped member 202 can be curved as shown in FIG. 2A. In alternate embodiments a U-shaped member's end sections 206 can extend from its middle section 204 at a sharp angle, such as a right angle or any other angle.

Figure 2B:
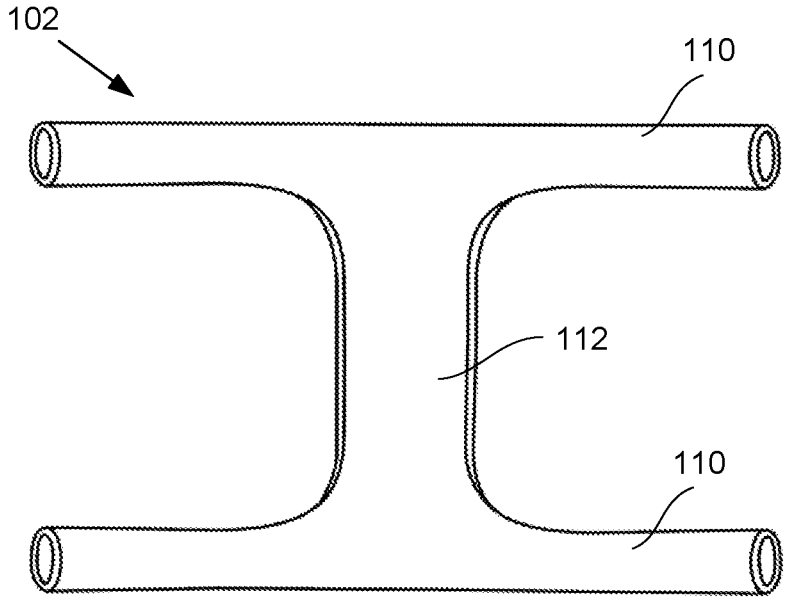
FIG. 2B depicts a second exemplary embodiment of a frame comprising a single I-shaped member.

FIG. 2B depicts a second exemplary embodiment of a frame 102. In some embodiments the frame 102 can be formed as a single substantially I-shaped component with top and bottom lateral arms 110 extending away from ends of a central support column 112. In some of these embodiments the top and bottom lateral arms 110 can be straight, while in other embodiments the top and bottom lateral arms 110 can be curved, V-shaped, or extend out of the central support column 112 in any other direction or with any other shape.

The components of the frame 102 can be comprise steel, aluminum, plastic, fiberglass, or other metals and materials. The frame's materials, shape, and/or thickness can result in the frame 102 being strong and durable enough to resist bending and breaking when some or all of a user's weight rests on the frame 102. In some embodiments the components of the frame 102 can be hollow, such that securing straps 106 can pass through the interior of the frame 102 as will be described below. By way of a non-limiting example, the U-shaped members 202 shown in FIG. 2A can be bent metal pipes with hollow interiors.

As shown in FIG. 1, pads 104 can cover at least a portion of each lateral arm 110. In some embodiments separate pads 104 can cover each lateral arm 110 on either side of the central support column 112. In other embodiments one pad 104 can extend across the top lateral arm 110, while another pad 104 extends across the bottom lateral arm 110. In these embodiments the pads 104 can be shaped with apertures or cutouts through which the central support column 112 can extend. In some embodiments one or more pads 104 can also cover some or all of the central support column 112.

The pads 104 can comprise cushioning material that is soft, resilient, and/or compressible. By way of non-limiting examples, the cushioning material can be gel, rubber, neoprene, high-density foam, or any other soft and/or elastomeric material. In some embodiments the pads 104 can additionally comprise covering material that surrounds or encloses its cushioning material. By way of non-limiting examples, the covering material can be nylon, canvas, polypropylene, polyester, rubber, plastic, or any other fabric or material. In some embodiments the covering material can be waterproof or water-resistant.

In some embodiments the pads 104 can extend fully around the front, top, back, and bottom of each lateral arm 110. By way of a non-limiting example, the pads 104 can be sleeves such that the lateral arms 110 can be inserted through the sleeves to fit the pads 104 around the lateral arms 110. By way of another non-limiting example, the pads 104 can be substantially planar members that can be wrapped fully around the lateral arms 110 and then be secured to themselves.

In alternate embodiments the pads 104 can cover a smaller portion of each lateral arm 110. By way of a non-limiting example, the pads 104 can be affixed to the front surfaces of the lateral arms 110 while the back surfaces are left uncovered.

In some embodiments the pads 104 can be fixed in place on the frame 102, such as being anchored in place or coupled to the frame 102 with adhesives. In other embodiments the pads 104 can wrap around the frame 102 but be rotatable or slideable along components of the frame 102.

The securing straps 106 and the positioning strap 108 can be webbing, belts, ropes, cords or other elongated members made of nylon, polypropylene, polyester, or any other material.

In embodiments in which the frame 102 is at least partially hollow, the ends of the lateral arms 110 can be open into their hollow interiors and the securing straps 106 can extend through hollow interior spaces of the frame 102 and exit the frame 102 through the open ends. As shown in FIG. 1, in some of these embodiments caps 114 defining a slit or other smaller opening can be coupled with the lateral arms 110 to cover their open ends, such that the securing straps 106 can exit the lateral arms 110 through the smaller openings in the caps 114. The caps 114 can be comprise plastic, metal, silicone, rubber, or any other desired material.

Figure 3A:
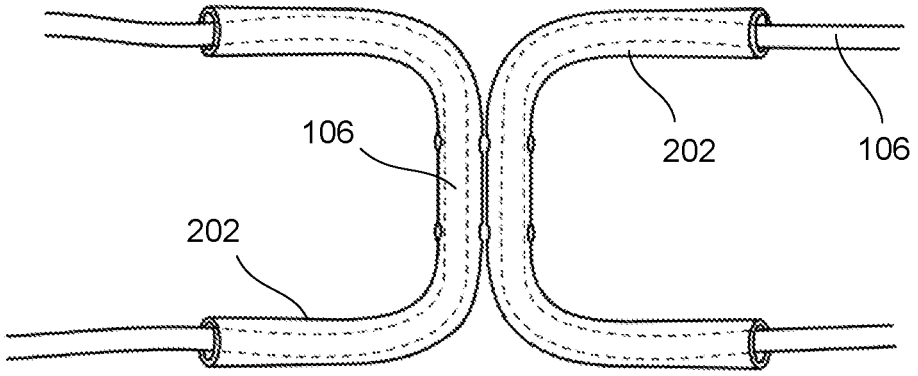
FIG. 3A depicts an embodiment with different securing straps passing through different U-shaped members.
Figure 3B:
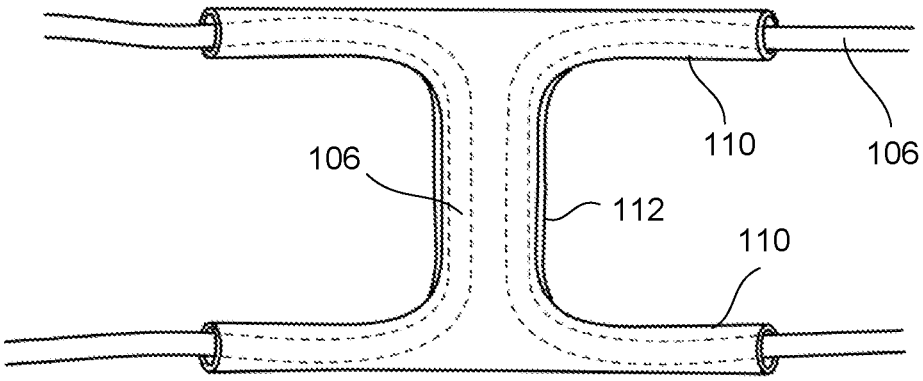
FIG. 3B depicts an embodiment with two securing straps passing through different sides of a single I-shaped member.

In some embodiments a particular securing strap 106 can enter and exit the frame 102 via open ends of lateral arms 110 on the same side of the central support column 112. By way of a non-limiting example, FIG. 3A depicts an embodiment in which different securing straps 106 pass through each U-shaped member 202. In this embodiment, a securing strap 106 enters an open end of one of a U-shaped member's end sections 206, extends through its middle section 204, and then exits out of the open end of the other end section 206. By way of another non-limiting example, FIG. 3B depicts an embodiment in which two securing straps 106 enter opposing ends of the top lateral arms 110, pass down the same central support column 112, and then exit opposing ends of the bottom lateral arms 110.

Figure 3C:
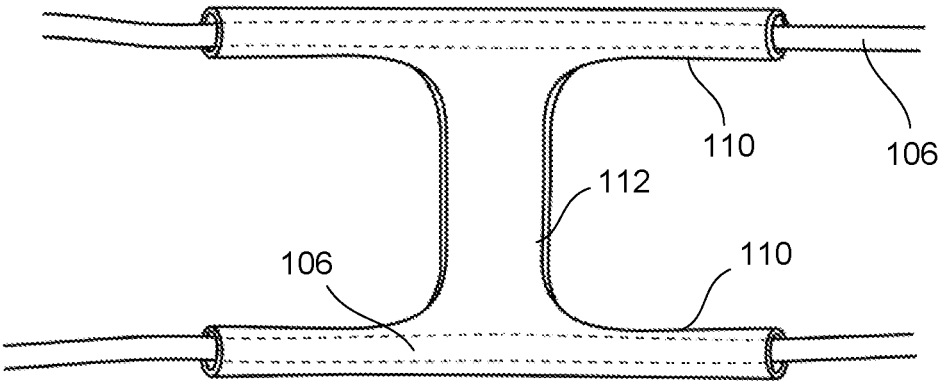
FIG. 3C depicts an embodiment with separate securing straps passing through upper and lower lateral arms.

In other embodiments a first securing strap 106 can extend laterally through the top lateral arms 110 while a second securing strap 106 can extend laterally through the bottom lateral arms 110. By way of another non-limiting example, FIG. 3C depicts an embodiment in which separate securing straps 106 pass through the top and bottom lateral arms 110 of a single-component I-shaped frame 102 without extending through its central support column 112. In these embodiments the central support column 112 can be solid or hollow.

In still other embodiments the securing straps 106 can extend along and/or be coupled with the exterior of the frame 102. By way of a non-limiting example, loops can extend out of the exterior surface of the frame 102, such that the securing straps 106 can pass through those loops on the frame's exterior and pass beyond the ends of the lateral arms 110.

When securing straps 106 extend through or along the central support column 112, in some embodiments fasteners at the central support column 112 can extend through the securing straps 106 to anchor the securing straps 106 in place at the central support column 112. By way of a non-limiting example, the bolts 208 shown in FIG. 2A that couple the middle sections 204 of the U-shaped members 202 can also extend through 208 securing straps 106 that pass through the U-shaped members 202. In other embodiments the securing straps 106 can pass through or along portions of the frame 102 without being anchored in place.

Figure 4A:
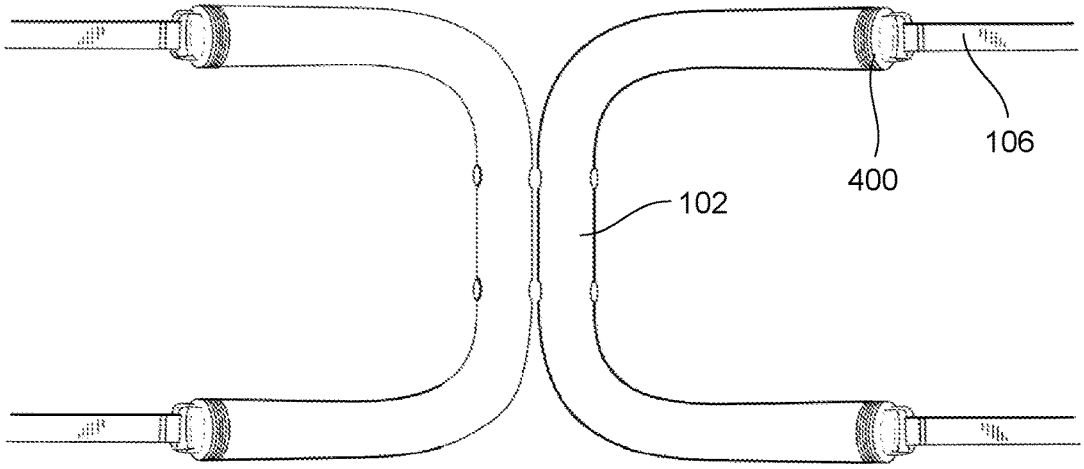
FIG. 4A depicts an embodiment with securing straps extending from ends of lateral arms.
Figure 4B:
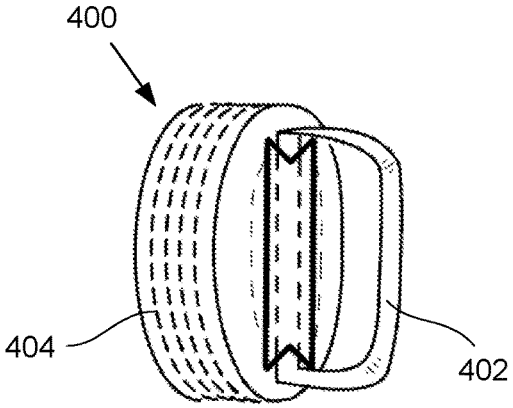
FIG. 4B depicts an embodiment of a connector for the end of a lateral arm with a hinged connector ring.
Figure 4C:
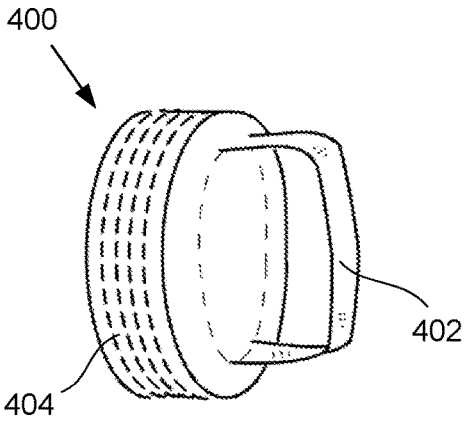
FIG. 4C depicts an embodiment of a connector for the end of a lateral arm with a fixed connector ring.

In alternate embodiments securing straps 106 can be coupled with ends of the lateral arms 110 without extending along or through the lateral arms 110. By way of a non-limiting example, FIG. 4 depicts an embodiment in which the ends of the lateral arms 110 terminate with connectors 400, and ends of the securing straps 106 can be coupled to the connectors. The connectors 400 can have a connector ring 402 such that a securing strap 106 can be clipped, hooked, looped, or otherwise coupled with the connector ring 402. In some embodiments the connector ring 402 can be coupled with the rest of the connector 400 with hinges such that it is movable as shown in FIG. 4B, while in other embodiments the connector ring 402 can be fixed in place on the connector 400 as shown in FIG. 4C. In some embodiments the connectors 400 can be caps that can close open ends of the lateral arms 110. By way of a non-limiting example, FIGS. 4B and 4C depicts embodiments of connectors 400 that have threads 404 such that the connectors 400 can be screwed into corresponding threads within open ends of lateral arms 110. In alternate embodiments the connectors 400 can be welded, fused, or otherwise coupled or integrated into ends of the lateral arms 110.

Returning to FIG. 1, the securing straps 106 can terminate at each end with corresponding strap connectors 116. The strap connectors 116 can be clips, buckles, hooks, latches, or any other mechanism that can couple one end of a securing strap 106 to its other end.

Ends of securing straps 106 extending from the frame 102 can be wrapped behind portions of a ladder and attached to each other with the strap connectors 116 to hold the frame 102 in place on the ladder. In some embodiments ends of securing straps 106 that extend from top lateral arms 110 can be attached to each other behind the ladder, while ends of securing straps 106 that extend from bottom lateral arms 110 can be similarly attached to each other behind the ladder. In other embodiments ends of securing straps 106 extending from the lower lateral arms 110 can be attached to ends of the securing straps 106 extending from the upper lateral arms 110, such that the securing straps 106 are arranged in an X-shape behind the ladder.

The securing straps 106 can comprise strap adjustors 118 that can be used to adjust the length of the securing straps 106. As such, the strap adjustors 118 can be used to tighten and/or loosen the securing straps 106 around the ladder when their strap connectors 116 are connected behind the ladder. Strap adjustors 118 can be slide adjustors, such as 2-bar slides or 3-bar slides, lock buckles, cam buckles, clamp, or any other type of strap adjustor.

The positioning strap 108 can be coupled with the frame 102, such that the frame 102 can hang from the positioning strap 108. The positioning strap 108 can extend substantially in line with the central support column 112, such that the frame 102 is substantially balanced on both sides of the positioning strap 108 when the frame 102 hangs from the positioning strap 108.

In some embodiments the positioning strap 108 can have one or more loops through which elements of the frame 102 can pass. By way of a non-limiting example, the positioning strap 108 can branch at one end into two loops as shown in FIG. 1 such that a first loop can fit around the top lateral arm 110 on a first side of the central support column 112 and a second loop can fit around the top lateral arm 110 on a second side of the central support column 112. By way of another non-limiting example, the positioning strap 108 can loop around the central support column 112 underneath the top lateral arm 110 and be secured to itself above the top lateral arm 110.

Figure 5A:
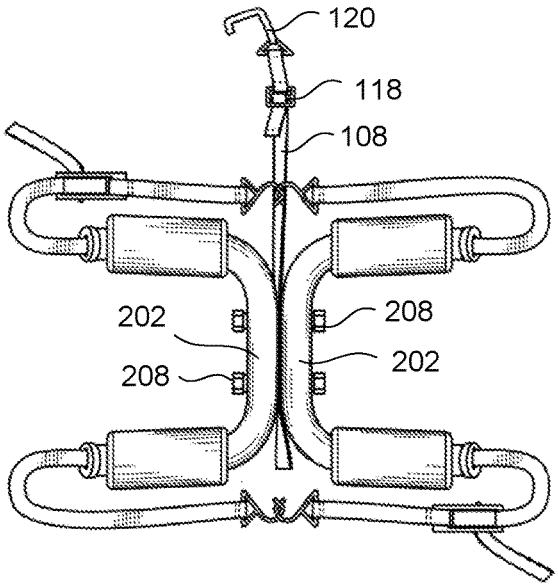
FIG. 5A depicts an embodiment in which a positioning strap extends between middle sections of two U-shaped members.
Figure 5B:
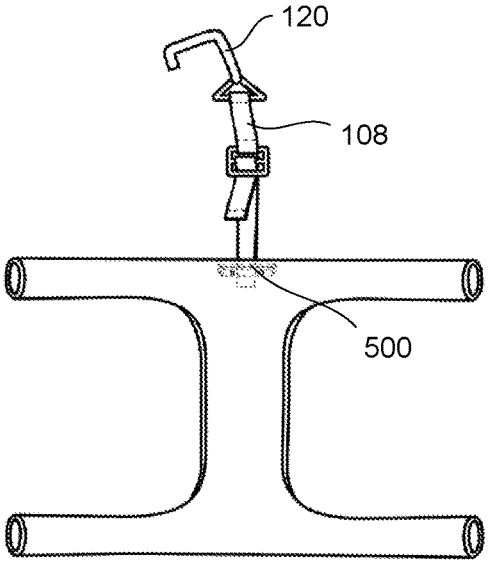
FIG. 5B depicts an embodiment in which a positioning strap is held by a bracket inside the frame.
Figure 5C:
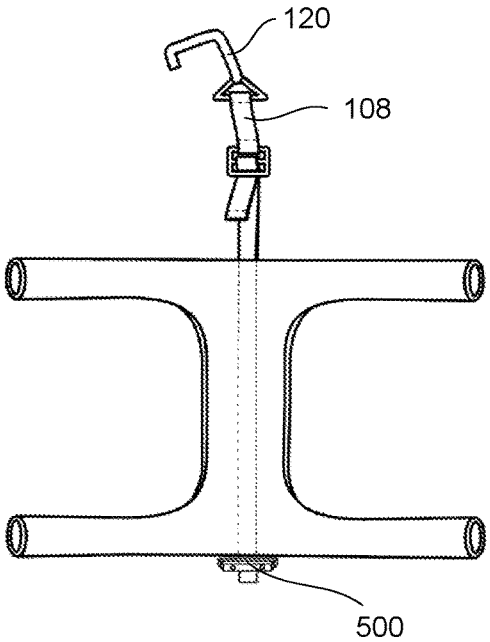
FIG. 5C depicts an embodiment in which a positioning strap is held by a bracket below the frame.

In alternate embodiments the positioning strap 108 can be coupled with the frame 102 with bolts, screws, brackets, or any other connection mechanism. By way of a non-limiting example, FIG. 5A depicts an embodiment in which the frame 102 comprises two U-shaped members 202, and the positioning strap 108 can extends at least partially between the two U-shaped members 202. As shown in FIG. 5A, bolts 208 that extend through the U-shaped members 202 can also extend through the positioning strap 108 to hold sections of the positioning strap 108 in place on the frame 102. By way of other non-limiting examples, the positioning strap 108 can terminate with a flanged bracket 500, such that the positioning strap 108 can enter the interior of the frame 102 through an upper aperture and be held within the frame's interior by the bracket 500 as shown in FIG. 5B, or extend through the central support column 112 and out of a lower aperture such that the bracket 500 can hold the positioning strap 108 on the frame's lower exterior surface as shown in FIG. 5C.

An end of the positioning strap 108 can be coupled with a ladder connector 120. A ladder connector 120 can be a hook, clip, latch, or any other type of connector that can be selectively attach the positioning strap 108 to a ladder. By way of a non-limiting example, the ladder connector 120 can be a hook that can be hooked onto a rung or step of a ladder.

In some embodiments the positioning strap 108 can terminate with a ring, such as a triangular ring, a D-ring, or O-ring, held in place with stitching, fusing, or any other coupling mechanism. In these embodiments, the ladder connector 120 can be permanently or removably coupled to the terminating ring at the end of the positioning strap 108. In other embodiments the ladder connector 120 can be coupled directly to an end of the positioning strap 108 with stitching, fusing, or any other coupling mechanism.

The positioning strap 108 can also have a strap adjustor 118 that can adjust the length of the positioning strap 108. As such, the strap adjustor 118 can be used to adjust length of the positioning strap 108 and thereby change the distance between the ladder connector 120 and the frame 102.

Figure 6:
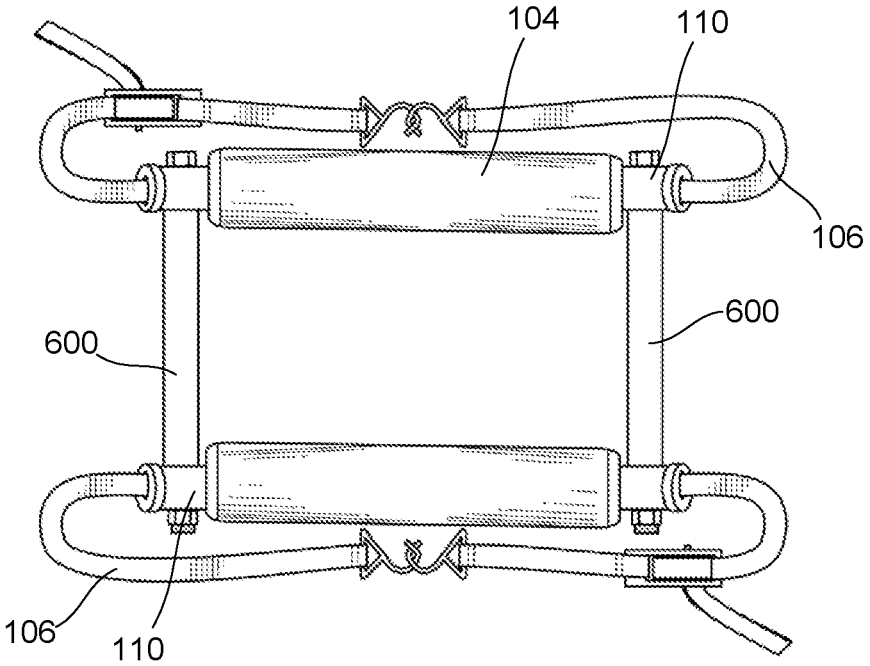
FIG. 6 depicts an alternate embodiment in which the frame is substantially rectangular.

FIG. 6 depicts an alternate embodiment of a ladder knee rest 100 in which the frame 102 is substantially rectangular. In this embodiment, the frame 102 can comprise top and bottom lateral arms 110 that are joined by two side support columns 600 positioned at opposing ends of the top and bottom lateral arms 110. In some embodiments the side support columns 600 can be separate components coupled with the top and bottom lateral arms 110 using bolts, screws, welding, fusing, adhesives, straps, brackets, or any other connection mechanism. In other embodiments the side support columns 600 can be integrated with the top and bottom lateral arms 110 such that the frame 102 is a single component.

In this embodiment pads 104 can at least partially cover the top and bottom lateral arms 110 between the two side support columns 600. Securing straps 106 can extend through hollow interiors of each of the top and bottom lateral arms 110, similar to the strap arrangement shown in FIG. 3C.

Figure 7:
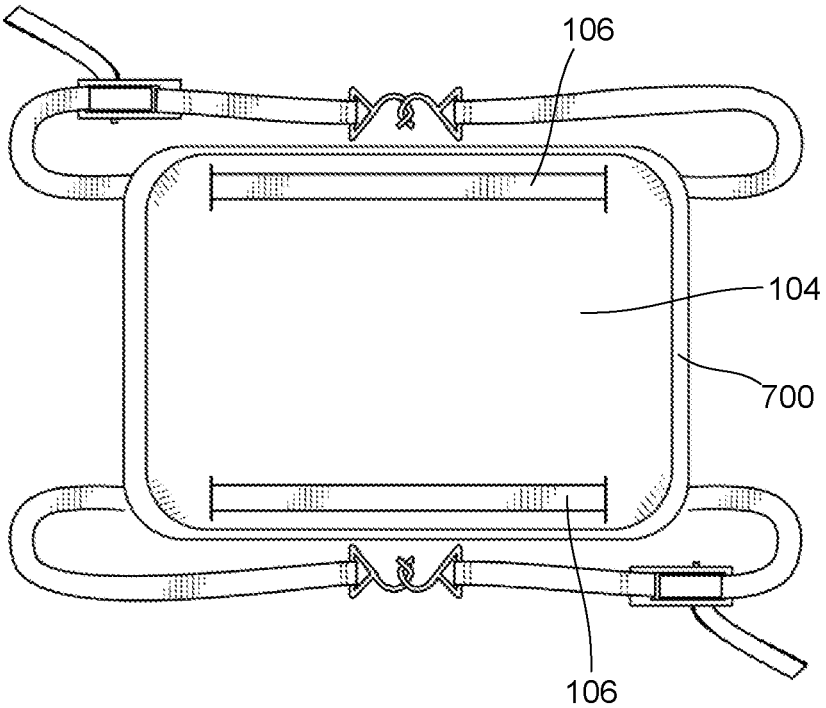
FIG. 7 depicts an alternate embodiment in which the frame is a sheet.

FIG. 7 depicts another alternate embodiment of a ladder knee rest 100 in which the frame 102 is a sheet 700. The sheet 700 can be substantially rectangular. In some embodiment the sheet 700 can be planar, while in other embodiments the sheet 700 can be curved or be formed with indentations to accommodate the shape of a user's knee.

In this embodiment one or more pads 104 can be coupled with the front face of the sheet 700, such that the sheet 700 is at least partially padded. Securing straps 106 can extend laterally proximate to the top and bottom edges of the sheet 700, and pass through two or more holes, slits, or other apertures in the sheet 700. In some embodiments the pads 104 can also have holes, slits, or other apertures through which the securing straps 106 can also pass as shown in FIG. 7. In other embodiments the securing straps 106 can pass between the sheet 700 and the pads 104, such that the securing straps 106 are covered by the pads 104 when they are in front of the sheet 700.

Figure 8:
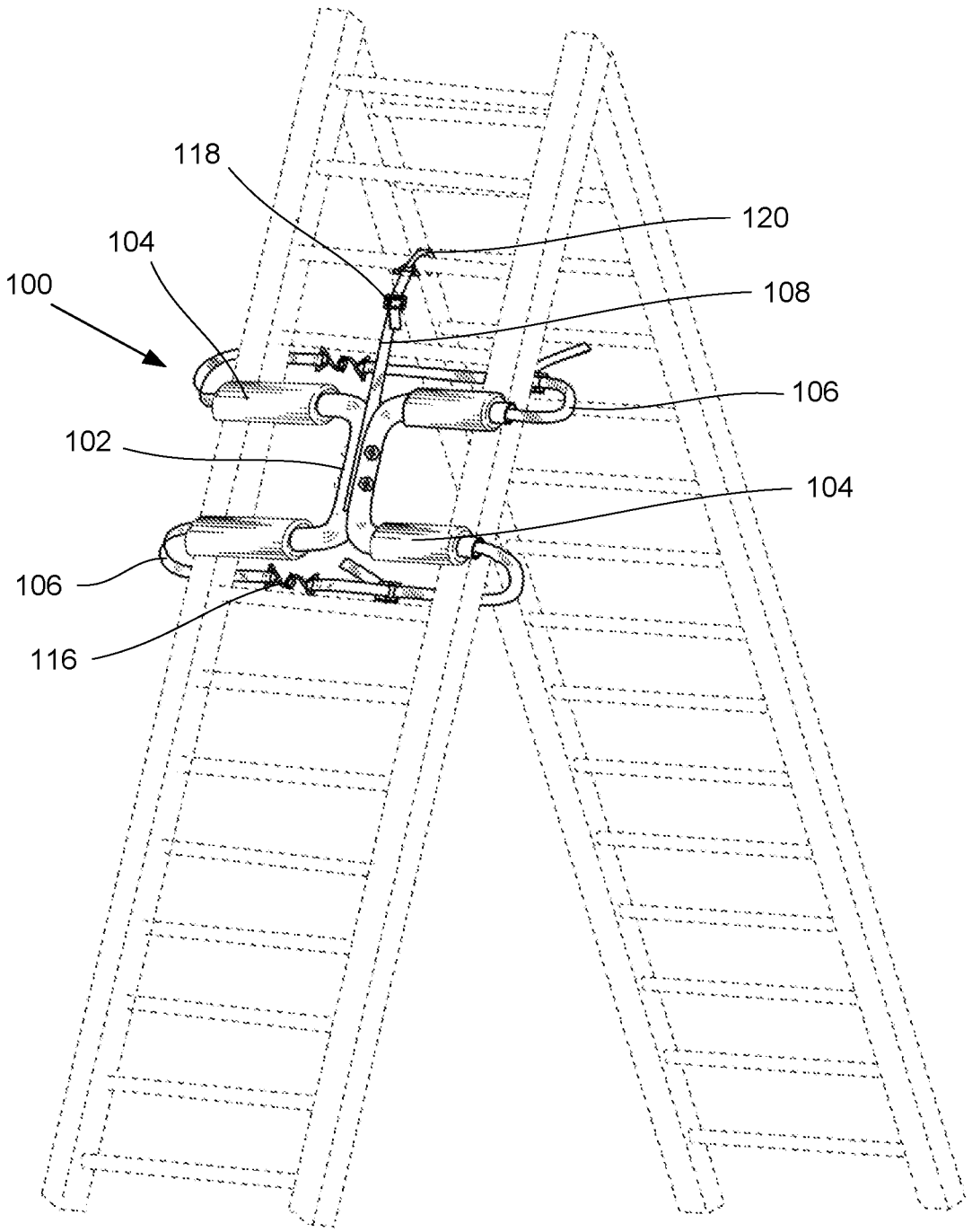
FIG. 8 depicts an embodiment of a ladder knee rest installed on a ladder.

FIG. 8 depicts an embodiment of the ladder knee rest 100 installed on a ladder. A ladder knee rest 100 can be installed by attaching the ladder connector 120 at an end of the positioning strap 108 to a ladder, such that the frame 102 hangs from the positioning strap 108 in front of the ladder. By way of a non-limiting example, the ladder connector 120 can be clipped to a rung on the ladder. In some embodiments the lateral arms 110 can extend past side rails of the ladder to keep the frame 102 in front of the ladder. A user can use a strap adjustor 118 adjust the length of the positioning strap 108, thereby raising or lowering the frame 102 relative to where the ladder connector 120 is attached to the ladder. As such, the user can adjust the length of the positioning strap 108 to move the frame 102 to a position where the user expects his or her knees to be while the user is on the ladder.

After the user has used the strap adjustor 118 on the positioning strap 108 to move the frame 102 vertically up or down the ladder to a desired position, the user can attach ends of the securing straps 106 together behind the ladder using strap connectors 116. The user can then tighten the securing straps 106 around the ladder using strap adjustors 118 on the securing straps 106. The securing straps 106 can thus prevent side to side movement of the ladder knee rest 100 when it is installed on a ladder.

Figure 9:
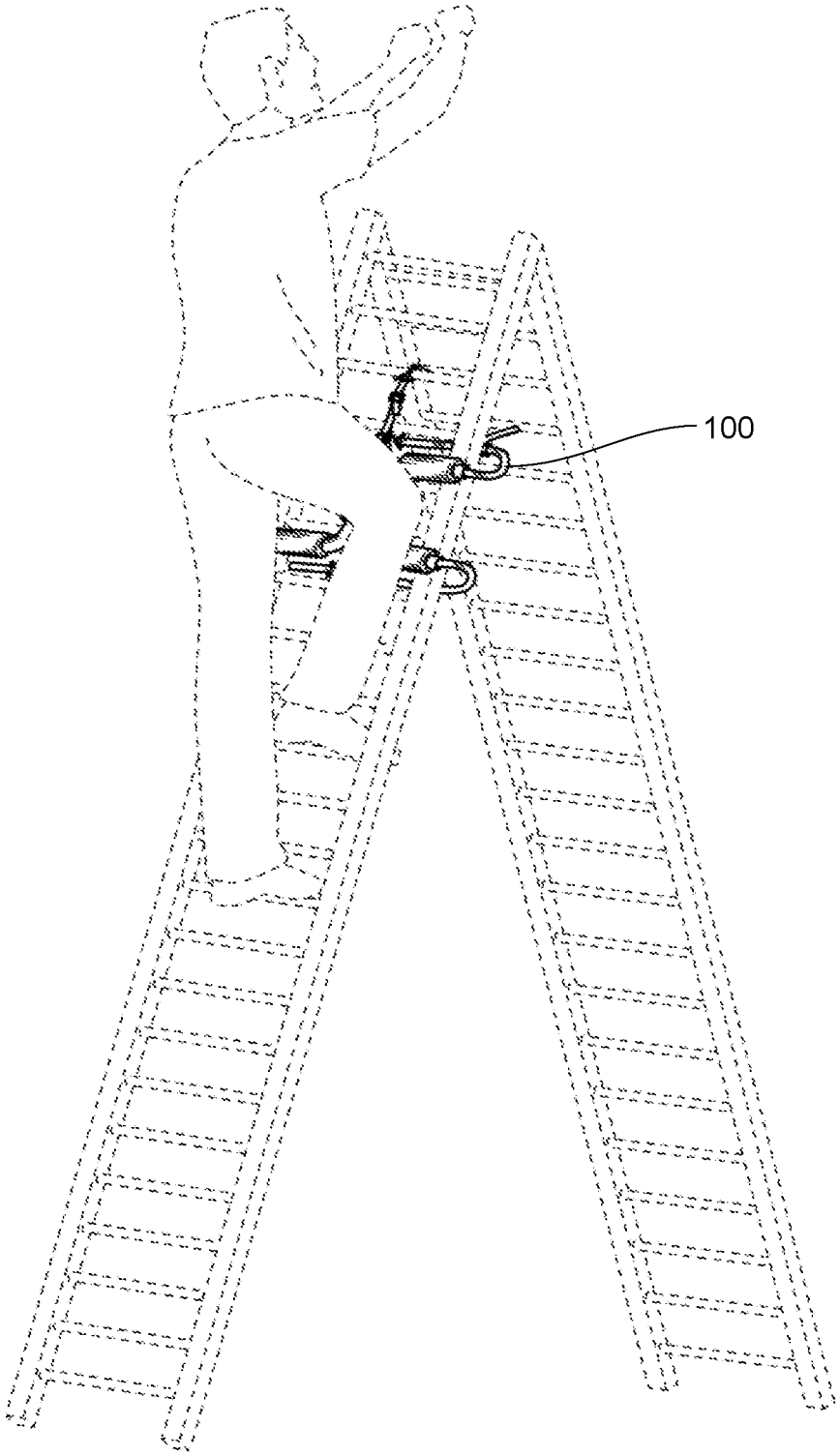
FIG. 9 depicts an embodiment of a ladder knee rest in use.

As shown in FIG. 9, after the ladder knee rest 100 has been installed on a ladder, a user can climb the ladder and rest one or both knees between the top and bottom lateral arms 110. When a user's knee rests between the top and bottom lateral arms 110, the user can contact his or her lower thighs and/or upper shins against the pads 104 on the lateral arms 110.

When a user wants to reposition the ladder knee rest 100, such as if the user wants to work higher or lower on the ladder, the user can loosen the securing straps 106 with their strap adjustors 118, use the strap adjustor 118 on the positioning strap 108 to move the frame 102 up or down to the desired position, and then re-tighten the securing straps 106 at the new position. Similarly, the ladder knee rest 100 can be removed from the ladder by loosening the securing straps 106, disconnecting the strap connectors 116, and removing the ladder connector 120 from the ladder.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A ladder knee rest, comprising:

a frame, said frame being substantially I-shaped and having top lateral arms and bottom lateral arms extending from ends of a central support column;

a plurality of pads disposed around at least a portion of said top lateral arms and bottom lateral arms;

securing straps extending from ends of said top lateral arms and bottom lateral arms, said securing straps terminating with corresponding strap fasteners; and a positioning strap coupled with said frame, said positioning strap having an adjustable length and terminating with a ladder connector configured to be attached to a ladder.

2. The ladder knee rest of claim 1, wherein said securing straps have an adjustable length.

3. The ladder knee rest of claim 1, wherein said frame is at least partially hollow such that said securing straps extend through said frame.

4. The ladder knee rest of claim 3, wherein each of said securing straps enters a top lateral arm, passes through said central support column, and exits out of a bottom lower lateral arm on the same side of the frame at which it entered the top lateral arm.

5. The ladder knee rest of claim 3, wherein a first securing strap extends laterally through said top lateral arms and a second securing strap extends laterally through said bottom lateral arms.

6. The ladder knee rest of claim 1, wherein said frame comprises two U-shaped members each having a middle section and two end sections extending substantially orthogonally from said middle section, wherein said middle sections of said two U-shaped members are coupled side to side such that said middle sections form said central support column and said end sections form said top lateral arms and said bottom lateral arms.

7. The ladder knee rest of claim 6, wherein said middle sections are coupled by bolts passing through said middle sections.

8. The ladder knee rest of claim 6, wherein said positioning strap extends between said U-shaped members.

9. The ladder knee rest of claim 1, wherein said positioning strap is coupled with said frame with two loops extending around said top lateral arms on either side of said central support column.

10. The ladder knee rest of claim 1, wherein said positioning strap is coupled with said frame with a loop extending around said central support column.

11. The ladder knee rest of claim 1, wherein each of said plurality of pads comprise inner cushioning material at least partially covered by a covering material.

12. A ladder knee rest, comprising:

a frame comprising two hollow U-shaped members each having a middle section and two end sections extending substantially orthogonally from said middle section, wherein said middle sections of said two hollow U-shaped members are coupled side to side to form a central support column and said end sections form top lateral arms and bottom lateral arms;

a plurality of pads disposed around at least a portion of said top lateral arms and bottom lateral arms;

a first securing strap and a second securing strap, said first securing strap extending through one U-shaped member and said second securing strap extending through the other U-shaped member, such that ends of said first securing strap and said second securing strap extend out of said top lateral arms and opposing ends of said first securing strap and said second securing strap extend out of said bottom lateral arms; and a positioning strap coupled with said frame, said positioning strap having an adjustable length and terminating with a ladder connector configured to be attached to a ladder.

13. The ladder knee rest of claim 12, wherein said first securing strap and said second securing strap have adjustable lengths.

14. The ladder knee rest of claim 12, wherein said positioning strap is coupled with said frame with two loops extending around said two hollow U-shaped members.

15. The ladder knee rest of claim 12, wherein said positioning strap extends between said two hollow U-shaped members.

16. The ladder knee rest of claim 12, wherein each of said plurality of pads comprise inner cushioning material at least partially covered by a covering material.

* * * * *